US007396255B2

(12) United States Patent
Morello et al.

(10) Patent No.: US 7,396,255 B2
(45) Date of Patent: Jul. 8, 2008

(54) ELECTRICAL CONNECTOR

(75) Inventors: John R. Morello, Warren, OH (US); Gerald A. Rhinehart, Jr., Lordstown, OH (US); Thomas G. Morello, Cortland, OH (US); William G. Strang, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/523,414

(22) Filed: Sep. 19, 2006

(65) Prior Publication Data

US 2008/0070440 A1 Mar. 20, 2008

(51) Int. Cl.
*H01R 13/44* (2006.01)

(52) U.S. Cl. ..... 439/595

(58) Field of Classification Search ..... 439/595, 439/752, 744, 721
See application file for complete search history.

(56) References Cited

U.S. PATENT DOCUMENTS 4,998,896 A * 3/1991 Lundergan ..... 439/595
5,520,553 A * 5/1996 Cecil et al. ..... 439/595
5,879,174 A 3/1999 Kountz et al.
5,980,318 A 11/1999 Morello et al.

* cited by examiner

*Primary Examiner*—Alexander Gilman
(74) *Attorney, Agent, or Firm*—David P. Wood

(57) ABSTRACT

An electrical connector has terminals that are retained in terminal cavities of a connector body by rigid lock nibs that project into the terminal cavity from a rigid wall and rigid lock nibs that are attached to a flexible beam that is opposite the rigid wall and that project into the terminal cavity.

9 Claims, 2 Drawing Sheets

ELECTRICAL CONNECTOR

BACKGROUND OF THE INVENTION

This invention relates generally to an electrical connector and more particularly to an electrical connector in which the connector body has a flexible beam for enhancing terminal retention.

U.S. Pat. No. 5,980,318 granted to John Morello et al. Nov. 9, 1999 discloses an electrical connector comprising a connector body that has a plurality of terminal receiving cavities. Each terminal receiving cavity is defined in part by a rigid floor and opposed upright walls. A rigid lock nib extends upwardly from the rigid floor into the terminal receiving cavity. A flexible beam opposes the rigid floor and engages a terminal in the cavity to hold the terminal against the rigid lock nib to retain the terminal in the terminal receiving cavity. The connector body is constructed and arranged for receiving a terminal in each terminal receiving cavity. This electrical connector is well suited for its intended purpose of housing and retaining terminals. However, terminal retention may be enhanced.

SUMMARY OF THE INVENTION

This invention provides an electrical connector comprising a connector body that has a terminal receiving cavity. The terminal receiving cavity is defined in part by a rigid wall and opposed upright walls. A rigid lock nib extends inwardly from the rigid wall into the terminal receiving cavity to retain a terminal in the receiving cavity. The connector body has a dual function flexible beam opposite the rigid wall of the terminal cavity. The flexible beam engages the terminal in the cavity to hold the terminal against the rigid lock nib to retain the terminal in the terminal receiving cavity. The flexible beam has a second rigid lock nib to enhance terminal retention.

DETAILED DESCRIPTION OF THE PREFERRED EMBODIMENTS

Figure 1:
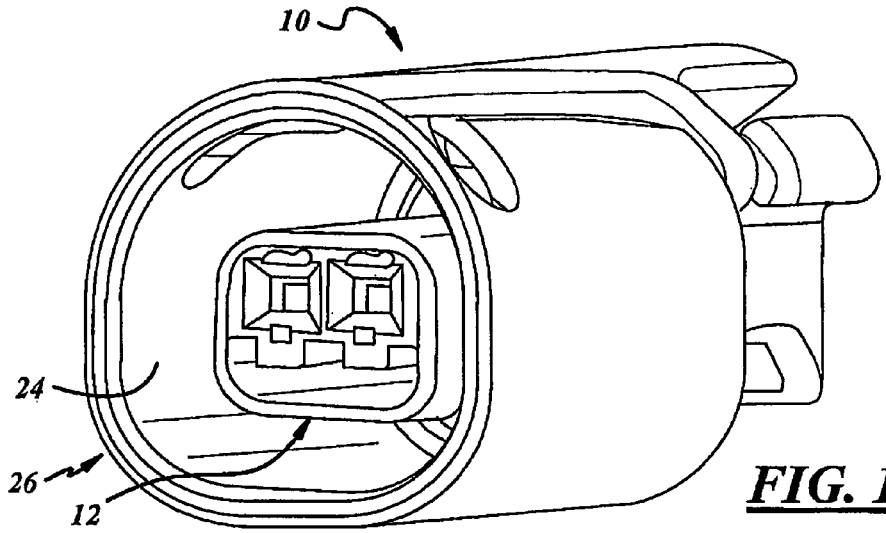
FIG. 1 is a perspective view of an electrical connector illustrating an embodiment of the invention.
Figure 4:
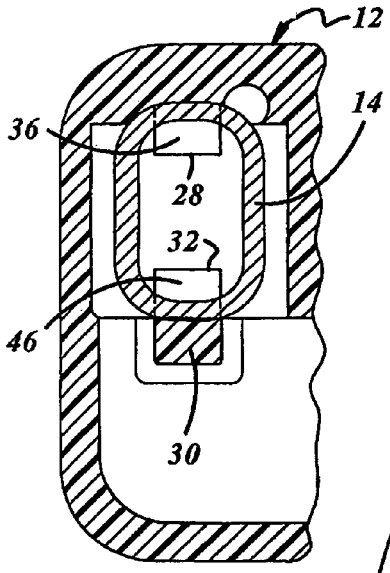
FIG. 4 is a transverse section of the electrical connector of FIG. 1 taken substantially along the line 4-4 of FIG. 3 looking in the direction of the arrows.
Figure 2:
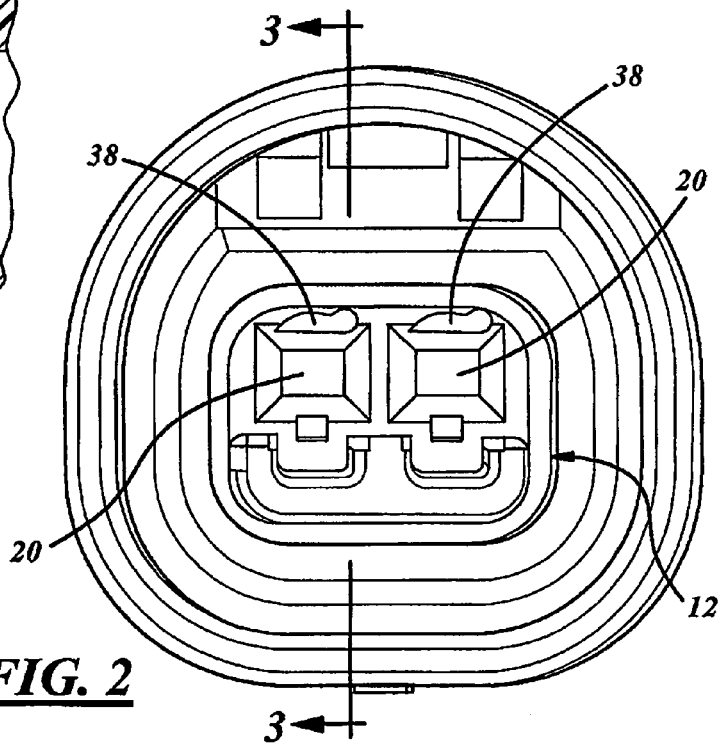
FIG. 2 is a front view of the electrical connector of FIG. 1.

Referring now to FIG. 1, electrical connector 10 comprises a connector body 12, a plurality of terminals 14 attached to insulated conductor wires 16. Connector body 12 has two terminal cavities 20 that extend through the connector body 12 from openings at an insertion end 22 to openings into an integral socket 24 at a mating end 26 of the connector body. Connector body 12 has rigid lock nibs 28 that project inward into the terminal cavities 20 from a rigid wall 18 for retaining the terminals 14 in the connector body 12. Flexible beams 30 opposite the rigid lock nibs 28 push the terminals 14 against the rigid wall 18 for retaining engagement with the rigid lock nibs 28 as best shown in FIG. 3.

The flexible beams 30 comprise second rigid lock nibs 32 and thus perform a dual function that enhances retention of terminals 14 in the terminal cavities 20 of connector body 12.

Figure 3:
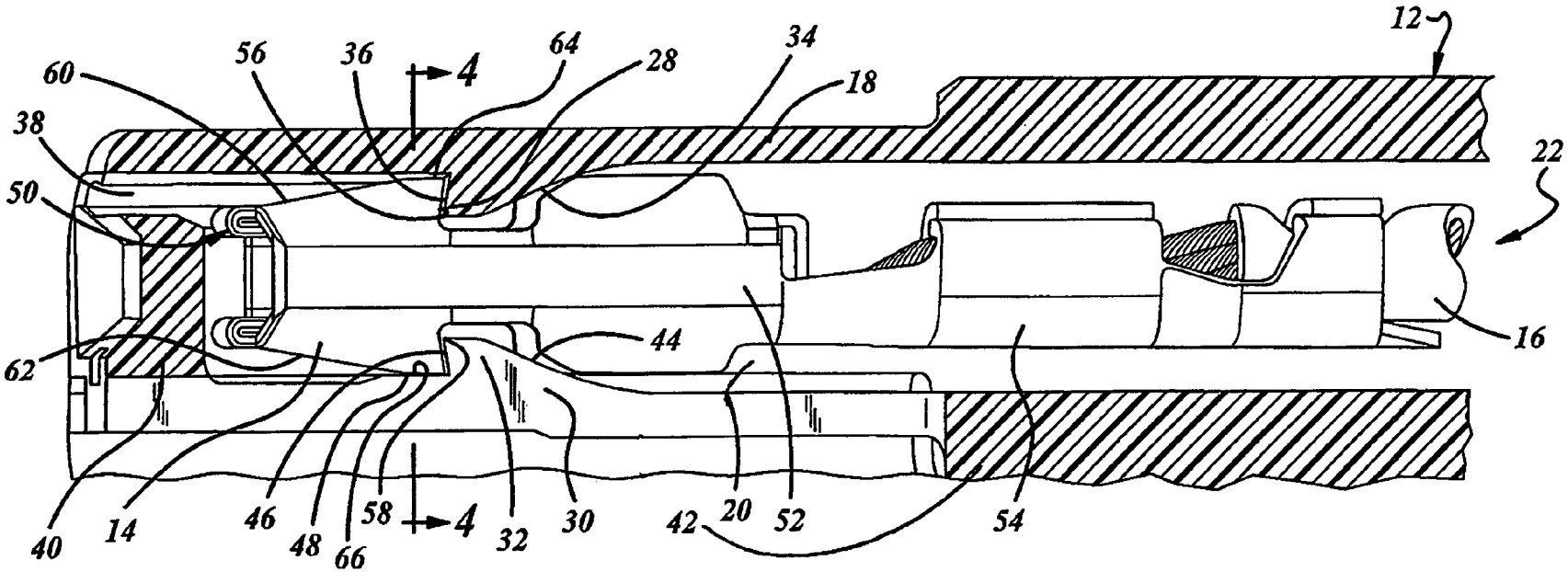
FIG. 3 is a longitudinal section of the electrical connector of FIG. 1 taken substantially along the line 3-3 of FIG. 2 looking in the direction of the arrows.

Focusing now on the typical terminal cavity 20 that is shown in FIG. 3, rigid lock nib 28 comprises a first ramp 34 that slopes inwardly and forwardly toward the mating end 26 of connector body 12. Ramp 34 leads to a first lock shoulder 36. The first lock shoulder 36 is preferably but not necessarily set at a slight back angle. The connector body 12 may include an access slot 38 for each terminal cavity 20 that extends inwardly from an opening at the mating end 26 of connector body 12 to the lock shoulder 36. The purpose of the access slot 38 is explained below.

The flexible beam 30 is attached at each end to longitudinally spaced rigid spaced wall portions 40 and 42 of connector body 12 that are opposite the rigid wall 18. The flexible beam 30 has a second rigid lock nib 32 comprising a second ramp 44 that also slopes inwardly and forwardly toward the mating end 26 of connector body 12. The second ramp 44 of the flexible beam 30 may have a lower slope so that terminal engages the second ramp 44 of the flexible beam 30 prior to engaging the ramp 34 of the rigid lock nib 28. This arrangement reduces the force required to insert and lock the terminal 14 in the terminal cavities 20 because the terminals do not engage the ramps 34 and 44 simultaneously.

Ramp 44 leads to a second lock shoulder 46. The second lock shoulder 46 is also preferably, but not necessarily set at a slight back angle. The flexible beam 30 includes a pressure pad 48 forwardly of the second lock shoulder 46.

Focusing now on the typical terminal 20, it generally comprises a forward contact portion 50, an intermediate body portion 52, and a rearward attachment portion 54 for attaching the terminal to the insulated conductor wire 16. The forward contact portion 50 of terminal 14 has laterally spaced lock surfaces 56 and 58. The forward contact portion 50 also preferably has ramps 60 and 62 that slant outwardly and rearwardly and lead to the respective lock surfaces 56 and 58. The forward contact portion 50 also preferably includes flats 64 and 66 located between the ramps 60 and 62 and the respective lock surfaces 56 and 58.

Terminals 14 are inserted into the respective terminal cavities 20 through openings at the insertion end 22 of the connector body 12. When the forward contact portion 50 of a typical terminal 14 engages the ramp 44, the flexible beam 20 is depressed. The flexible beam 20 is then continuously depressed further and further as the contact portion 50 rides along ramp 44, eventually engaging ramp 34 and then also riding along ramp 34. When terminal lock surfaces 56 and 58 reach lock shoulders 36 and 46, flexible beam 20 springs up whereupon pressure pad 48 engages flat 66 so that the flexible beam 30 pushes terminal 14 against rigid wall 18 and the two rigid lock nibs 28 and 32 engage behind the respective lock surfaces 56 and 58 of terminal 14.

Terminals 14 are preferably but not necessarily symmetrical about a horizontal plane so that the terminals 14 are insertable into the respective terminal cavities 20 either right side up as best shown in FIG. 3 or upside down.

Each terminal 14 can be removed from its terminal cavity 20 by inserting a tool into access slot 38 and depressing the terminal 14 until the lock surfaces 56 and 58 are released by the lock shoulders 36 and 46 rigid lock nibs 28 and 32.

While electrical connector 10 is illustrated with two terminal cavities 20, the electrical connector may have one or any multiple number of terminal cavities.

In other words, it will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connector comprising a connector body and at least one terminal, the connector body having at least one terminal cavity that extends through the connector body from an opening at an insertion end to an opening at a mating end of the connector body, the connector body having a first rigid terminal lock nib that projects inward into the terminal cavity from a rigid wall for retaining the terminal in the connector body and a flexible beam opposite the first rigid lock nib for pushing the terminal against the rigid wall and into retaining engagement with the first rigid lock nib, the flexible beam having a second rigid lock nib that projects inward into the cavity from the flexible beam for retaining the terminal in the connector body to enhance terminal retention, and the terminal having laterally spaced lock surfaces transversely faced and engageable with the first rigid lock nib and the second rigid lock nib respectively to prevent withdrawal of the terminal from the terminal cavity of the connector body.

2. The electrical connector as defined in claim 1 wherein the flexible beam is attached at each end to longitudinally spaced rigid spaced wall portions and that are opposite the rigid wall and wherein the flexible beam has a second rigid lock nib comprising a second ramp that also slopes inwardly and forwardly toward the mating end of the connector body and leads to a second lock shoulder; the second lock shoulder preferably, but not necessarily being set at a slight back angle.

3. The electrical connector as defined in claim 1 wherein the rigid terminal lock nib comprises a ramp that slopes inwardly and forwardly toward the mating end of the connector body and leads to a first lock shoulder; the first lock shoulder preferably but not necessarily being set at a slight back angle.

4. The electrical connector as defined in claim 3 wherein the flexible beam is attached at each end to longitudinally spaced rigid spaced wall portions and that are opposite the rigid wall and wherein the flexible beam has a second rigid lock nib comprising a second ramp that also slopes inwardly and forwardly toward the mating end of the connector body and leads to a second lock shoulder; the second lock shoulder preferably, but not necessarily being set at a slight back angle.

5. The electrical connector as defined in claim 4 wherein the second ramp has a lower slope than the first ramp to reduce the force required to insert and lock the terminal in the terminal cavity.

6. An electrical connector comprising a connector body and at least one terminal, the connector body having at least one terminal cavity that extends through the connector body from an opening at an insertion end to an opening at a mating end of the connector body, the connector body having a first rigid terminal lock nib that projects inward into the terminal cavity from a rigid wall for retaining the terminal in the connector body and a flexible beam opposite the first rigid lock nib for pushing the terminal against the rigid wall and into retaining engagement with the first rigid lock nib, the flexible beam having a second rigid lock nib that projects inward into the cavity from the flexible beam for retaining the terminal in the connector body to enhance terminal retention, and the terminal having laterally spaced lock surfaces engaging the first rigid lock nib and the second rigid lock nib respectively to prevent withdrawal of the terminal from the terminal cavity of the connector body, wherein the first rigid terminal lock nib comprises a ramp that slopes inwardly and forwardly toward the mating end of the connector body and leads to a first lock shoulder; the first lock shoulder preferably but not necessarily being set at a slight back angle, wherein the flexible beam is attached at each end to longitudinally spaced rigid spaced wall portions and that are opposite the rigid wall and wherein the second rigid lock nib comprises a second ramp that also slopes inwardly and forwardly toward the mating end of the connector body and leads to a second lock shoulder; the second lock shoulder preferably, but not necessarily being set at a slight back angle, and wherein the flexible beam includes a pressure pad forwardly of the second lock shoulder for pushing the terminal against the rigid wall and into retaining engagement with the first rigid lock nib.

7. An electrical connector comprising a connector body and at least one terminal, the connector body having at least one terminal cavity that extends through the connector body from an opening at an insertion end to an opening at a mating end of the connector body, the connector body having a first rigid terminal lock nib that projects inward into the terminal cavity from a rigid wall for retaining the terminal in the connector body and a flexible beam opposite the first rigid lock nib for pushing the terminal against the rigid wall and into retaining engagement with the first rigid lock nib, and the flexible beam having a second rigid lock nib for retaining engagement with the terminal in the connector body to enhance terminal retention, wherein the flexible beam is attached at each end to longitudinally spaced rigid spaced wall portions and that are opposite the rigid wall and wherein the flexible beam has a second rigid lock nib comprising a second ramp that also slopes inwardly and forwardly toward the mating end of the connector body and leads to a second lock shoulder; the second lock shoulder preferably, but not necessarily being set at a slight back angle, wherein the terminal generally comprises a forward contact portion having laterally spaced lock surfaces engageable with the rigid lock nibs respectively, and wherein the forward contact portion comprises ramps that slant outwardly and rearwardly to lead to the respective lock surfaces.

8. The electrical connector as defined in claim 7 wherein the forward contact portion comprises flats and located between the ends of the ramps and the respective lock surfaces.

9. The electrical connector as defined in claim 7 wherein the terminal is symmetric about a horizontal plane so that the terminal is insertable into the terminal cavity right side up or upside down.

* * * * *